United States Patent [19]

Kush et al.

[11] Patent Number: 4,601,112

[45] Date of Patent: Jul. 22, 1986

[54] LIQUID EDGEBEAD REMOVAL DEVICE

[75] Inventors: Donald C. Kush, Pleasanton; Gary A. Hust, Tracy, both of Calif.

[73] Assignee: Kaiser Aluminum & Chemical Corporation, Oakland, Calif.

[21] Appl. No.: 744,712

[22] Filed: Jun. 14, 1985

[51] Int. Cl.[4] ..... F26B 5/12; F26B 5/14

[52] U.S. Cl. ..... 34/9; 34/16; 34/71; 34/95; 34/152

[58] Field of Search ..... 34/9, 16, 71, 95, 152; 15/306 A, 308, 409; 72/40

[56] References Cited

U.S. PATENT DOCUMENTS

| | | | |
|---|---|---|---|
| 3,039,513 | 6/1962 | Lasiewicz | 72/40 |
| 3,192,752 | 7/1965 | Dowd et al. | 72/45 |
| 3,251,331 | 5/1966 | Crawford | 15/409 |
| 3,601,837 | 8/1971 | Conrad et al. | 15/316 R |
| 3,978,546 | 9/1976 | Epina et al. | 15/306 A |
| 4,231,164 | 11/1980 | Barbee | 34/16 |
| 4,477,287 | 10/1984 | Kush et al. | 15/345 |

*Primary Examiner*—Albert J. Makay
*Assistant Examiner*—David W. Westphal
*Attorney, Agent, or Firm*—Andrew E. Barlay

[57] ABSTRACT

This invention is concerned with an improved apparatus system and method for removing liquid coolant from the side marginal edges of a continuously moving metal strip or sheet after it exits from a rolling mill and subsequent to the prior diversion and collection by a suitable device of the liquid rolling mill coolant that may otherwise contact and deleteriously rewet the top and bottom surfaces of the moving strip as it exits from the mill. The invention in its preferred embodiment involves use of a pair of improved combination strip edge wiping or contacting roller and vacuum creating units that are located adjacent the path of travel and each of the opposing side marginal edges of the moving strip. The roller in each unit serves not only to track and properly locate the vacuum creating components relative to a marginal side edge of the strip and thus maintain substantially continuous contact therebetween but at the same time advantageously functions to remove and divert coolant away from the strip edges in and of itself. In effect the combination strip edge contacting rollers and associated vacuum creating elements of the units act as secondary or supplemental liquid coolant diversion and removal devices that insure the final capture and removal of substantially all liquid coolant from all portions of the strip prior to coiling whereby the strip can be said to be substantially coolant free.

22 Claims, 4 Drawing Figures

LIQUID EDGEBEAD REMOVAL DEVICE

BACKGROUND OF THE INVENTION

This invention relates to an improved apparatus, system and method for removing liquid rolling mill coolant from moving metal strip. More particularly it is concerned with removing liquid coolant from the side marginal edges of continuously rolled heavy gauge flat metal strip products such as flat metal strips or sheets of aluminum and aluminum alloys. As indicated in U.S. Pat. No. 4,477,287 issued Oct. 16, 1984, various devices have been developed in the past for removing liquid coolant, and in particular water based liquid coolant from rolled aluminum and aluminum alloys to prevent the formation of what is commonly referred to in the art as "water stain". The method and equipment as disclosed in this patent involves a unique arrangement of vacuum creating units and air knives which remove substantially all of the liquid rolling mill coolant from the top and bottom surfaces as well as the edges of the strip, when the metal strip has a guage or thickness below 0.050" (1.27 mm).

Despite the fact that the method and equipment disclosed in the aforesaid patent, which include the customary use of a billy or idler roll, perform satisfactorily in removing liquid coolants from some metal strip such as aluminum strip having a thickness or gauge of less than about 0.050" (1.27 mm), there are occasions where it is not practical to use such a device. For example, when relatively heavy gauge metal strips such as aluminum and aluminum alloy strip having a gauge of about 0.050" (1.27 mm), and above are rolled and then subjected to liquid coolant removal operations including strip edge coolant removal a billy roll is relatively useless and impractical. This is because billy rolls do not serve to present substantially flattened heavy gauge aluminum strip to coolant removal units due to the inability of such heavy gauge aluminum strip of 0.050" (1.27 mm) thickness and beyond to conform properly to the surfaces of such billy or idler rolls as a consequence of their thickness. Thus at times there may be some slight deviations in heavy guage strip or sheet flatness which can cause interference with current edge liquid coolant removal equipment such as that disclosed in the aforementioned patent and thus detract from overall equipment efficiency. For example, a minor edge wave in 0.125" (3.175 mm) gauge or thickness of rolled aluminum sheet can be as far as 1" (25.4 mm) from the roll on which it is being wrapped or passed.

For the purposes of this invention the term "heavy gauge" strip or sheet as used in the specification and claims shall mean aluminum and aluminum alloy strip having a gauge thickness of at least about 0.050" (1.27 mm) up to at least about 0.249" (6.32 mm) the dividing line between aluminum and aluminum alloy sheet and plate.

Accordingly it is a primary purpose of the instant invention to provide an improved method, system and apparatus for removing liquid coolant from the marginal side edges of a moving metal sheet or strip.

It is another purpose of the instant invention to provide a unique method, system and apparatus for effecting efficient removal of a liquid such as liquid coolant from the edge of a moving heavy gauge sheet or strip.

It is a further purpose of the instant invention to provide an improved method, system and apparatus for effecting efficient removal of a liquid coolant from the edges of a fast moving strip of metal such as an aluminum metal alloy strip regardless of variations in the normal rolled strip or sheet width and/or the location of the instant coolant removal units relative to a rolling mill.

It is another purpose of the invention to provide improved rolling mill strip edge liquid coolant removal equipment that can be readily integrated and operated with existing metal rolling mill equipment arrangements including top and bottom strip surface liquid coolant diversionary or removal units.

It is still another purpose of the instant invention to provide a unique method, system and apparatus for producing and presenting for coiling substantially water stain free aluminum and aluminum alloy sheet particularly in the heavy gauges.

These and other purposes are achieved in the instant invention by use of unique combination edge contacting wiping roller and vacuum units arranged adjacent to and in contact with the side marginal edges of a fast moving metal strip. These units operate to effect substantially complete removal of any residual liquid coolant that may still be present on or cling to the side marginal edges usually, if at all, in heavy gauge metal strip and subsequent to a prior coolant diversion or removal operations.

One preferred embodiment of the invention contemplates that the instant units would be used in conjunction with any suitable metal strip coolant deflection blow-off system where a gaseous medium such as dry air is directed simultaneously over and across the top and bottom surfaces of the strip and toward the side edges of the strip so as to inhibit among other things deleterious rewetting of the strip while diverting liquid coolant into side collection troughs. When the instant roller-vacuum units are operated in conjunction with such strip surface blow-off systems substantially coolant free strip will have been processed and passed to the usual coiling mechanisms.

The type of top and bottom surface blow-off equipment that might be used is disclosed to some extent in U.S. Pat. No. 3,192,752 issued July 6, 1965.

BRIEF DISCUSSION OF THE DRAWINGS

DETAILED DESCRIPTION OF THE INVENTION

Figure 1:
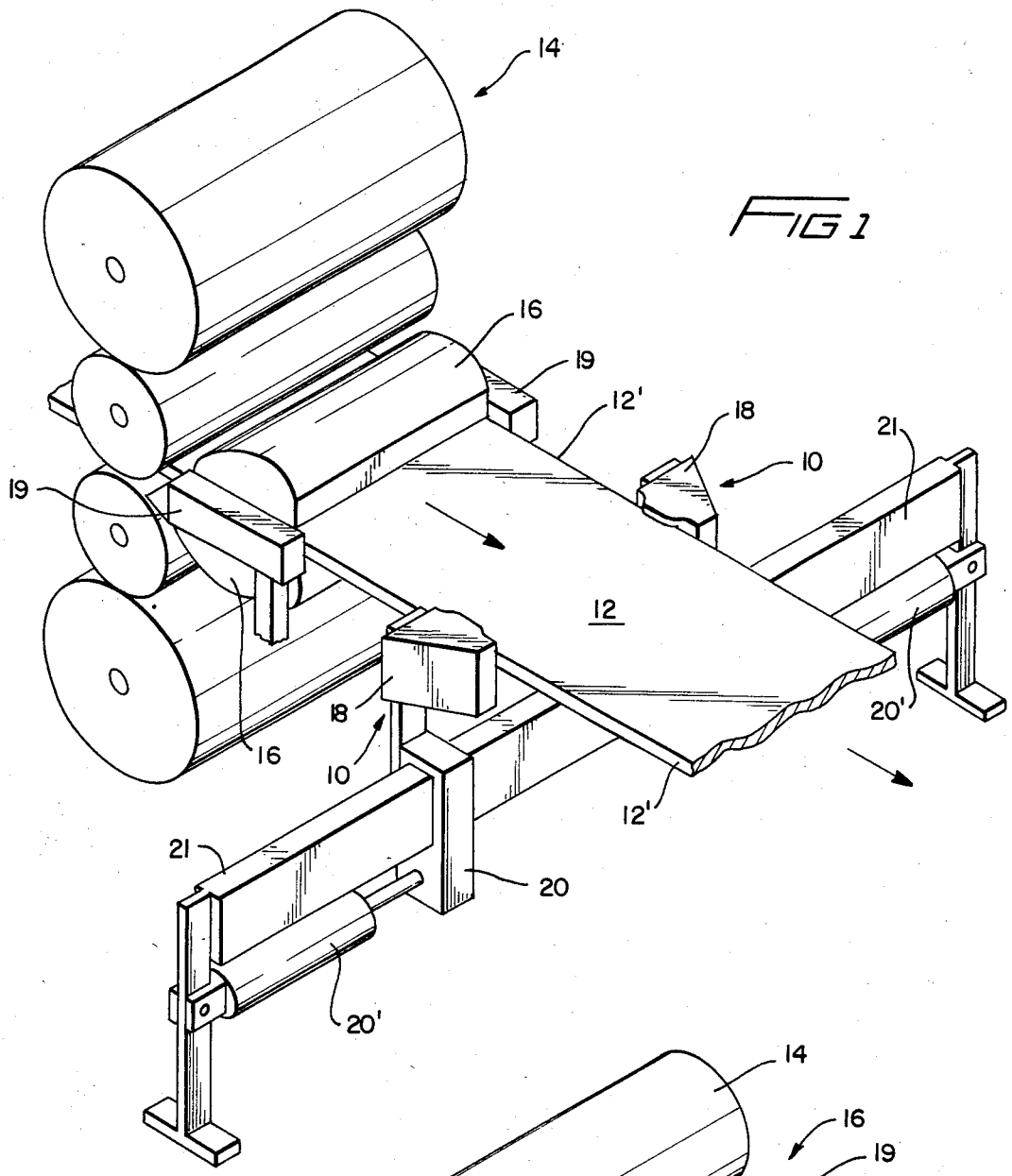
FIG. 1 is an isometric view of a preferred overall arrangement for mounting the combination edge contacting roller and vacuum creating units adjacent a moving strip as it exits from a mill roll stand and prior to being coiled.

Although the inventive concepts of the instant device, system and method will be discussed with particular reference to their use in the aluminum industry, it is to be understood that they can also find application in other industries where similar problems are involved and can be solved by use of such concepts. With further reference to the drawings, it will be seen that a preferred device, system and method for practicing the instant invention generally involves the use of a pair of combination edge contacting or wiping roller and vacuum creating units 10. Units are assemblages 10 are adapted to be located adjacent to the two opposite marginal side edges of a moving strip 12 of metal e.g. an aluminum alloy of about 0.50" (1.27 mm) thickness gauge or greater as it exits from the rolling mill stand 14. Units 10 are also located somewhat downstream from the mill stand 14 and at points or areas where they will function subsequent to the operation of other acceptable primary liquid coolant removal or surface coolant diversionary devices enclosed in a housing 16.

Figure 1A:
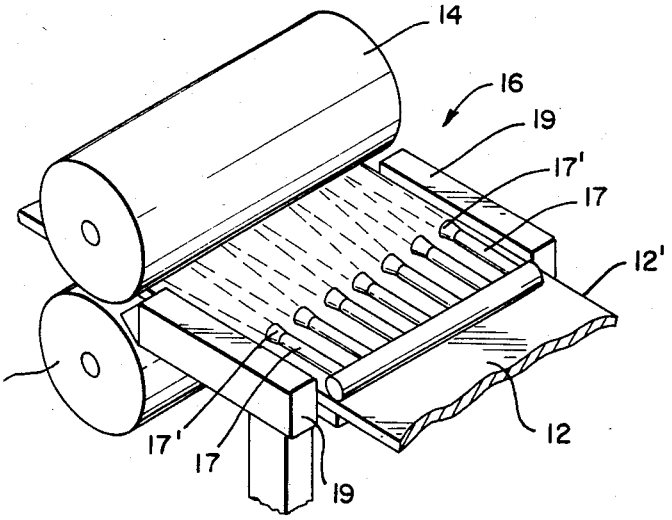
FIG. 1A is an enlarged sometric fragmentary view with parts removed and parts broken away of various dry air jet elements enclosed in the surface blow-off system housing of FIG. 1.

As indicated in FIGS. 1 and 1A enclosed within the upper and lower housings 16 shown schematically in FIG. 1 are upper and lower dry and compressed air jet pipes 17 with spray heads or nozzles 17' connected to a suitable air pressure source not shown. The pipes and nozzles 17 and 17' force dry compressed air to sweep simultaneously over the top and bottom surfaces of the metal strip 12 so as to inhibit deleterious rewetting of the strips top and bottom surfaces while diverting or directing liquid coolant present at the exit side of the mill stand and in close proximity to the top and bottom surfaces of the strip into elongated side collection troughs 19 the interiors of which are ultimately connected to suitable containment systems e.g. air exhaust or vacuum systems not shown. As succeeding portions of the strip pass between top and bottom housings 16 metal strip with substantially dry top and bottom surfaces will be presented to each unit 10.

Figure 2:
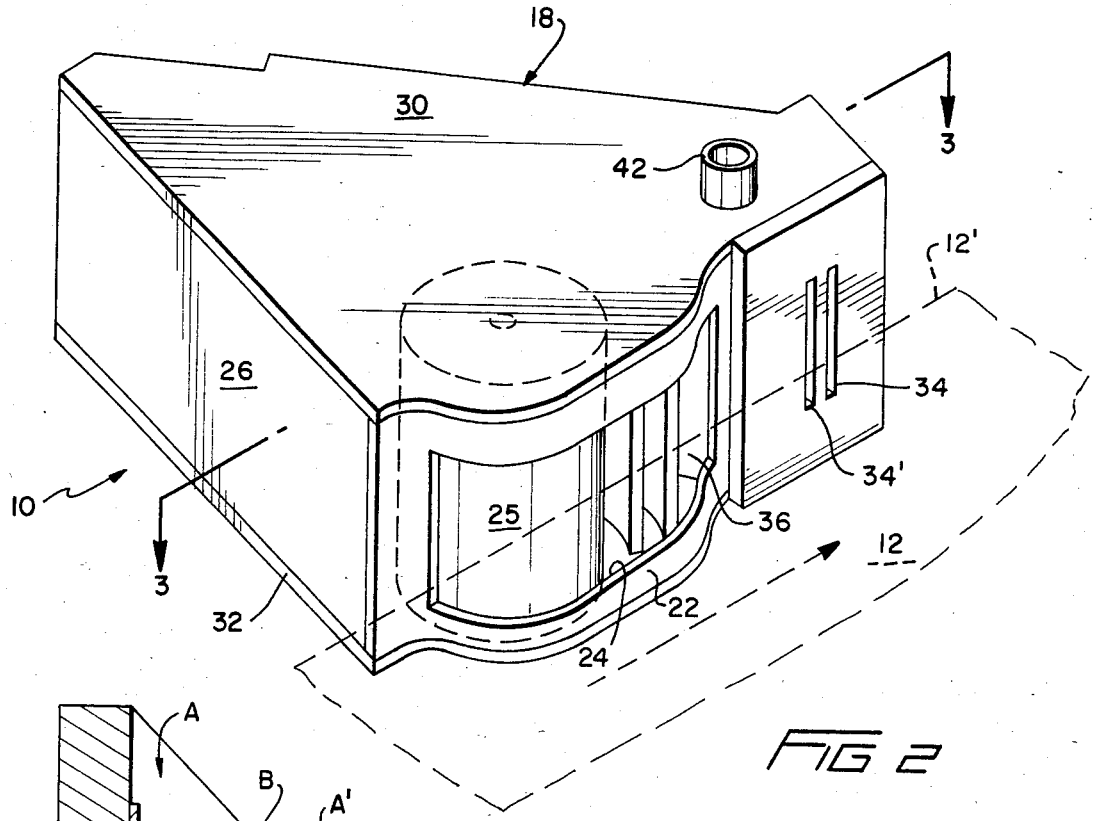
FIG. 2 is a further enlarged isometric view of a combination edge contacting roller and a vacuum creating unit of the instant invention showing its location adjacent the marginal edge of a moving strip.
Figure 3:
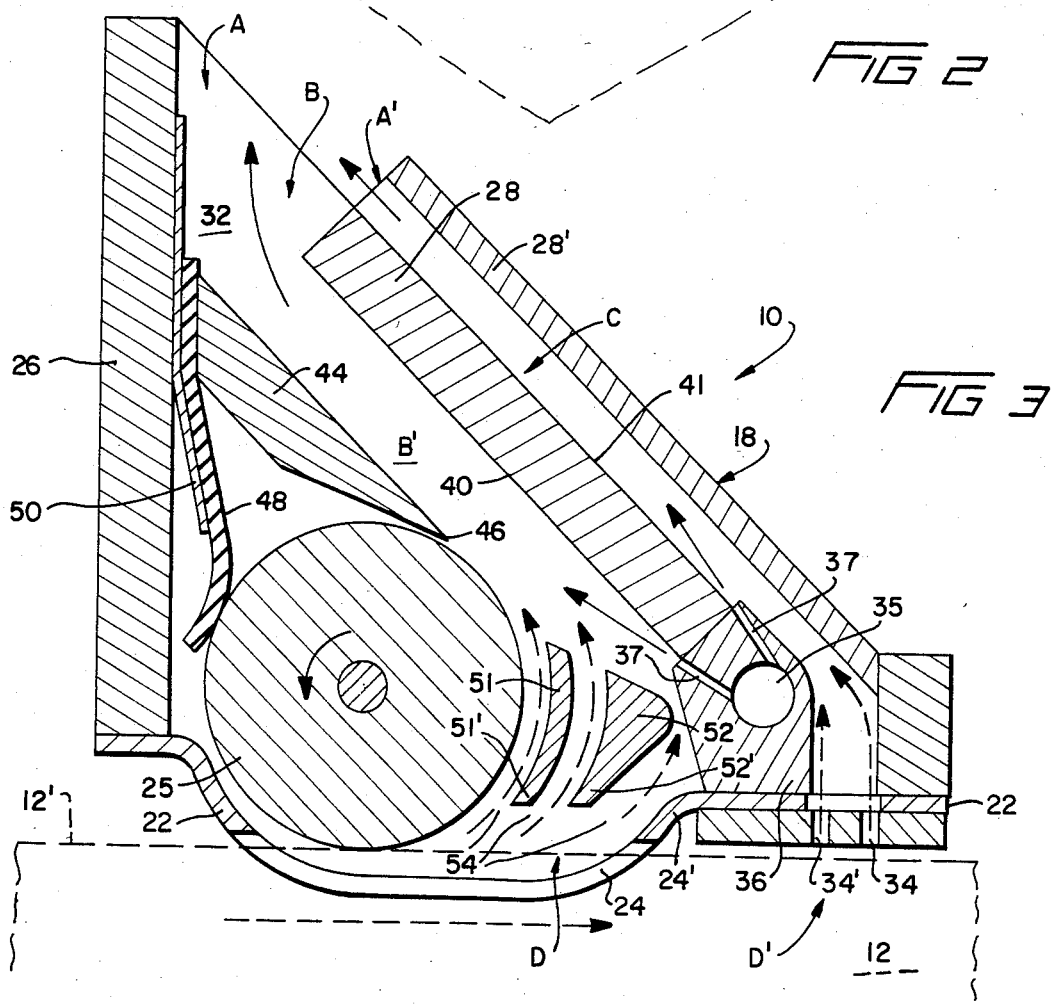
FIG. 3 is a cross sectional view of the combination edge contacting roller and vacuum creating unit of FIG. 2 when taken generally along the line 3—3 thereof.

Since each unit 10 is similarly constructed, a description of one unit will suffice for both. In one advantageous embodiment of the invention each unit 10 which functions independently of and without interference from the other unit of the pair, includes a housing 18 which is mounted on and supported by a slide or carrier block 20. Each block 20 is mounted on a slide bar 21 as well as being connected to a suitable air cylinder assembly 20' which is used to constantly urge its associated bearing block 20 and housing 18 into close relationship with a given marginal side edge 12' of the moving strip 12 being continuously coiled on a conventional coiling arbor or collapsible reel not shown. With further reference to the drawings, and in particular FIGS. 2 and 3, it will be observed that each housing 18 for a combination wiping roller and vacuum creating unit 10 includes a somewhat outwardly extending and curved front wall 22 provided with an opening or window 24. The front wall 22 and window 24 are curved in order for the marginal edge 12' of a passing strip 12 to be able to protrude slightly into the window as will be discussed hereinafter. Housing 18 is supported on a bearing block 20 at such a height relative to strip 12 whereby the marginal edge 12' of the strip 12 can protrude into the open window 24 preferably at about the midpoint in the height of the window 24 and into contact with the wiping roller 25 mounted in housing 18. Front wall 22 is appropriately attached to the angled or converging side walls 26 and 28 and side wall 28 terminates short of wall 26 to provide a primary exhaust opening A for the housing 18. Side walls 26 and 28 are removably attached to top and bottom covers 30 and 32 by suitable means, not shown, so that the covers may be removed to gain access to the interior of housing 18 when needed. Walls 26 and 28 along with covers 30 and 32 form a main compartment B.

Freely rotatable within compartment B of a housing 18 so that it can be readily rotated by contact with the edge 12' of the moving strip 12 is the strip edge contacting or wiping roller 25. This roller is mounted in such a fashion that its peripherial portion projects outwardly while remaining within the confines of the window or opening 24 and with its axis normal or transverse to the top and bottom surfaces of the sheet or strip 12. This mounting arrangement allows roller 25 to be advantageously brought into tangential tracking contact and under the desired constant and light pressure from it associated air cylinder assembly 20' with a given marginal edge 12' of the sheet or strip 12. The height or length of the roller is such whereby it will remain in substantially constant contact with the marginal edge 12' of the strip regardless of the nonflat condition of such marginal edge of the rolled strip 12. Normally housing 18 and roller 25 are adjusted heightwise relative to the strip whereby the mid part of roller 25 will generally contact the strip. Thus it will be seen as indicated, particularly in FIG. 2, that, as residual liquid coolant clinging to a marginal edge 12' of the moving strip or sheet 12 tangentially contacts a roller 25, it will be advantageously diverted away from the edge 12' of the sheet and into chamber B of housing 18 as roller 25 constantly tracks and maintains a wiper like contact with a given marginal edge 12' of the strip 12. Certain portions of the diverted liquid coolant will advantageously flow in a helical pattern along the surface of roller 25 while other portions will flow in one or more airborne streams which are angled away from the strip in a manner to be described hereinafter.

A preferred embodiment of the invention contemplates that each housing 18 be fitted with an additional side wall 28'. Side wall 28' is disposed in spaced parallel relation to wall 28 and forms in conjunction therewith a further air exhaust duct or channel C in addition to that provided by a section B' of compartment B formed by wall 28 and baffle 44 to be described. Channel C is in constant open communication with the elongated front wall openings or slots 34 and 34' and secondary exhaust opening A'. Although only two slots or openings are used any number can be employed. Slots 34 and 34' are exposed to the marginal edge 12' of the strip 12 and are located somewhat downstream from window 24.

The arrangement or scheme for converting and operating section B' of chamber B and chamber C as primary and secondary vacuum air exhaust ducts along with primary and secondary exhaust openings A and A' will now be described. The end of wall 28 closest to window 24 and front wall 22 can be fitted with an enlargement 36 welded or otherwise secured both to wall 22 and wall 28. A vertical bore 35 can be drilled in the enlarged section 36 of wall element 28 and a series of other intersecting horizontal bores 37 drilled in such section 36 so as to communicate with the common bore 35. Bores 37 also communicate respectively with the exhaust air channels or ducts B' and C and they can be drilled such that each of their central axis is set at about a 10° angle relative to the various wall surfaces 40 and 41 of wall 28 exposed to channels B' and C respectively. As indicated in FIG. 2 a pipe fitting 42 for bore 35 can be welded to the top of enlarged wall section 26 so that it can protrude through top cover 30 for ultimate connection to a suitable source of air under pressure. The bottom opening of bore 35 is closed by bottom cover 32. Any number of small bores or openings 37 can be used depending on the results desired.

In a further advantageous embodiment of the invention a partial baffle wall element 44 can be disposed in chamber B. Wall element 44 is fitted with a knife edge 46 at the point where it is located in close proximity to the roller 25. Wall element 44 is mounted in chamber B along with a roller wiper 48 for roller 25 that is made from a suitably resilient or flexible material such as an appropriate grade of rubber along with a metal wiper backing plate 50. Coolant picked up by wiper 48 can be collected by drain pipes not shown to the extent required. From the above it will now be seen that when air is introduced under pressure into the main bore 35 from a suitable air source, not shown, air will be forced to exit under selected pressure from the diverging orifices or bores 37 into B' and C thereby creating negative pressures and a vacuum or suction in the forward areas D and D' of these air channels or in the forward areas of the housing exposed to the marginal side edge of the sheet or strip 12 that is being acted upon.

A preferred embodiment of the invention contemplates that a series of vacuum control plates 51 and 52 be used in the forward area D of compartment B. When the upstanding vacuum control plates 51 and 52 are located adjacent the window-like opening 24 and close to the rotating roller 25 in compartment B they will increase the velocity of induced air flow through the window 24 and through chamber portion B' of compartment B so that airborne containment of liquid from the strip 12 is optimized. At the same time the liquid from roller 25 which has also been removed from the strip by way of a roller 25 in its diversionary action will also be caught up and exhausted through channel B' and the primary exhaust opening A to a suitable collection point or unit, not shown. Control plates 51 and 52 can be selectively curved and spaced from each other to form the desired venturi passages 54 in chamber B for enhancing removal of liquid coolant from the edge portions of a strip 12 that is moving through the window-like section 24 of a given unit 10 all as indicated particularly in FIG. 3. The shape and dimensions of these plates are preferably such that their forward terminal edges 51' and 52' will be located relatively close to the moving strip 12. The auxiliary front wall slots 34 and 34' and passageway or chamber C in a further preferred embodiment of the invention perform valuable functions in the containment and subsequent capture of the last vestiges of liquid coolant that may possibly have escaped capture in the venturi passages 54 of compartment B due to the normal sheared irregularities in the strip edges that result in the rolling of metal e.g. aluminum.

From the above it will now be seen that the air supply and discharge systems described advantageously produce within a unit 10 negative pressure not only within a housing 18 adjacent the area where the roller 25 is mounted and the window 24 is located but also in the forward portion of auxiliary passage C directly connected to the auxiliary suction slots 34 and 34'. Further the particular arrangements of the various elements in a given housing means that the air and the liquid coolant entrained therein are finally exhausted through the openings A and A' provided at the back of the housing and away from the strip proper. In other words these openings A and A' are so located that the discharging liquid cannot contact the strip or sheet 12 in a return or bypass fashion thereby avoiding coolant short circuiting.

Although not shown it is to be understood that in coiling of the strip 12 the path line of the strip will advantageously be controllably centered within the vertical dimensions of the window-like openings 24. The constant contact between each roller element 25 and a given marginal edge of the strip is maintained by using a light constant force applied by the use of a suitable air cylinder assembly 20' previously described or by suitable compression springs. By virtue of this scheme the rollers 25 are able to freely contact the strip without binding and regardless of variations in width of the rolled metal strip. The rollers are also preferably mounted in suitable free wheeling bearings and they are preferably made from either stainless steel or provided with a chrome plate surface so as to have the normal wearing characteristics desired.

While the instant apparatus, system and method provide for effective removal of a liquid or the final liquid coolant residue clinging to the edge of a moving rolled sheet or strip and regardless of the varying degrees of sheet thickness or flatness it is particularly useful for processing heavy gauge metal strip. The simplicity and compactness of the units means they can be easily maintained. They are not prone to malfunction readily and advantageously operate independently of and without interference with each other.

While the instant device system and method have been discussed with particular reference to their use in the handling or removal of water based coolant accumulation from the marginal side edges of cold rolled heavy gauge aluminum materials they can be used to advantage in other environments where other metals are rolled and have similar side edge coolant removal problems. For example, the instant device system and method find equal application in removing strip edge oil based coolant. It is also to be noted in the event for any reason the exhaust air pressures in chambers B and C should momentarily drop below the desired levels that the terminal edges 51' and 52' of plates 51 and 52 and downstream curved window wall 24' along with a roller 25 would still trap a substantial amount of the deflected coolant so that a decrease in overall unit efficiency would be minimized.

Advantageous embodiments of the invention have been disclosed and described and it is obvious that various changes and modifications may be made therein without departing from the spirit and scope thereof as defined in the appended claims.

What is claimed is:

1. In a device of the type described for removing liquid coolant from the side marginal edge of a continuously moving metal strip being coiled, the combination of:

A. roller means mounted adjacent a side marginal edge of the strip with the axis of the said roller means being disposed at a substantially transverse angle to the strip's top and bottom surfaces for continuously contacting and wiping said side marginal edge of the moving strip intermediate the ends of the roller means the strip contacting surface of the roller means being imperforate and rigid;

B. vacuum creating means associated with the said roller means for assisting said roller means in removing liquid coolant from the said marginal edge of the strip adjacent said roller means; and C. means including window means for mounting said roller means and said vacuum creating means adjacent the side marginal edge of the strip and for maintaining said roller means in substantially constant contact with said side marginal edge of the strip whereby said roller means can function to divert liquid from the marginal edge of the strip as well as track said strip and maintain said vacuum creating means in close proximity to said strip's side marginal edge.

2. The device of claim 1 wherein said means for maintaining said roller means in constant contact with said marginal edge of the strip comprises piston and cylinder means.

3. The device of claim 1 wherein said vacuum creating means includes means for introducing air under pressure into said device so as to create in an area adjacent said window means at least one vacuum producing air stream directed away from said roller means within which the diverted liquid coolant can be entrained.

4. The device of claim 1 wherein said vacuum creating means includes vacuum control plate means associated with window and roller means.

5. The device of claim 1 including additional apertured wall means located downstream from said window means.

6. The device of claim 5 wherein the apertures of said additional apertured wall means comprise elongated slotted openings arranged crossways to the top and bottom surfaces of the strip.

7. The device of claim 5 wherein the window and vacuum control plate means and the apertures of said additional apertured wall means comprise parts of primary and secondary vacuum creating means.

8. The device of claim 7 including means connecting the primary and secondary vacuum creating means to exhaust means.

9. The device of claim 1 including wiping and wall baffle means for said roller means.

10. In a rolling mill system wherein a first liquid coolant diverting and removal means is located adjacent the exit end of a mill stand for inhibiting rewetting of the top and bottom surfaces of the strip by liquid coolant and for diverting liquid coolant from the top and bottom surfaces of the moving strip so as to create substantially dry strip surface conditions and a second liquid coolant diverting and removal means is located downstream from said first mentioned liquid coolant diverting and removal means and adjacent to each of the side marginal edges of the strip for removing residual coolant from the said side marginal edges of the strip said second liquid coolant diverting and removal means comprising:

A. a pair of combined edge contacting roller and vacuum creating units with each unit being located adjacent a separate side marginal edge of the strip and with each roller in a unit having a rigid imperforate strip contacting surface;

B. means including window means in a unit for adjustably mounting said roller and vacuum creating units on opposite sides and adjacent each side marginal edge of the strip in opposed relationship to each other and with the roller axis of a unit being arranged normal to the top bottom surfaces of the strip; and C. means for forcing the rigid imperforate surface of the roller in each unit into a light yet substantially constant contact with a given side marginal edge of the moving strip whereby the vacuum producing elements of a unit can act in conjunction with the roller of such unit to continuously remove residual liquid coolant from a side marginal edge of the strip and present substantially coolant free strip to further strip processing equipment.

11. A rolling mill system as set forth in claim 10 wherein a roller and vacuum producing unit includes means for introducing air into said unit to create an air stream directed away from the roller of said unit and within which the removed liquid coolant can be entrained in an area of said window means that is located close to but downstream from where the roller is mounted.

12. A rolling mill system as set forth in claim 10 wherein a roller and vacuum producing unit includes venturi means disposed closely adjacent the roller of the unit and adjacent a part of the window means located downstream from the roller so as to induce a negative pressure in the area of the roller and thereby facilitate liquid coolant removal from the strip.

13. A rolling mill system as set forth in claim 12 wherein the venturi means includes vacuum control plate means installed adjacent a part of the window means in the unit that is located downstream from the roller and closely adjacent the roller of the unit for increasing the velocity of induced air flow through the window means and for optimizing capture and entrainment of airborne liquid coolant.

14. A rolling mill system as set forth in claim 10 wherein a roller and vacuum creating unit includes a first vacuum creating means located immediately adjacent the roller of a unit and in an area of the window means that is located downstream from the roller and a second vacuum creating means located downstream from said first vacuum creating means.

15. A rolling mill system as set forth in claim 14 including means for introducing a plurality of liquid coolant entrainment air streams into a roller and vacuum creating unit and for directing at least one of said air streams immediately away from the area where the roller of said unit is located.

16. A rolling mill system as set forth in claim 10 wherein a roller and vacuum creating unit includes a housing provided with said window means through which a marginal side edge portion of the strip is adapted to be partially projected and into tangential contact with the roller of the unit.

17. A method for removing residual liquid coolant from the side marginal edges of a moving flat rolled strip of metal as it moves from the discharge end of a rolling mill stand and subsequent to the exposure of the top and bottom surfaces of the moving strip to a dry blow-off gaseous medium and the diversion of liquid coolant therefrom comprising the steps of:

A. simultaneously and continuously contacting each of the two side marginal edges of the strip with a separate roller to effect full free rotation of each roller;

B. allowing each of the said rollers during the rotation thereof to separately divert externally of the roller selected portions of liquid coolant away from the respective side marginal edge of the strip with which a particular roller is associated; and C. while allowing the diversion of selected portions of liquid coolant to take place by the action of the said rollers also creating negative pressure and a separate vacuum outside of and immediately adjacent but downstream from each roller and adjacent the top and bottom surfaces of the strip so as to both independently effect removal of liquid coolant from the strip edges and at the same time enhance the containment and subsequent capture of the liquid coolant that is diverted from the side marginal edges of the strip by the rollers.

18. The method as set forth in claim 17 including the additional step of creating a further vacuuming of the two side marginal edges of the strip at points located further downstream from the points where said first mentioned vacuuming steps take place.

19. The method of claim 17 including the step of allowing the contacting surfaces of the rollers in and of themselves during the rotation thereof to divert at least portions of liquid coolant from the side marginal edges of the strip.

20. The method of claim 17 wherein the strip being treated comprises heavy gauge strip.

21. A method for removing residual liquid coolant from the marginal side edges of a moving flat rolled strip of metal as it exits from the discharge end of a rolling mill stand and subsequent to the exposure of the top and bottom surfaces of the moving strip to a dry blow-off gaseous medium and the diversion of liquid coolant therefrom comprising the steps of:

A. simultaneously and continuously contacting each of the two side marginal edges of the strip with a separate roller the axis of which is arranged normal to said top and bottom surfaces of said strip and the strip contacting surface of which is rigid and imperforate to effect full and free rotation of each roller; and B. while maintaining strip edge and roller contact allowing each of said rollers to separately divert immediately externally of the roller liquid coolant away from the respective side marginal edge of the strip with which a particular roller is associated and toward liquid coolant capture means.

22. The method of claim 21 wherein the strip being treated comprises heavy guage strip.

* * * * *